US005868878A

United States Patent [19]

Matossian et al.

[11] Patent Number: 5,868,878

[45] Date of Patent: Feb. 9, 1999

[54] HEAT TREATMENT BY PLASMA ELECTRON HEATING AND SOLID/GAS JET COOLING

[75] Inventors: Jesse N. Matossian, Canoga Park; John D. Williams, Agoura Hills; Wilfried Krone-Schmidt, Fullerton, all of Calif.

[73] Assignee: Hughes Electronics Corporation, El Segundo, Calif.

[21] Appl. No.: 113,550

[22] Filed: Aug. 27, 1993

[51] Int. Cl.[6] ..... C21D 1/09

[52] U.S. Cl. ..... 148/565; 148/222; 148/586; 148/660; 148/712; 148/713; 219/121.59

[58] Field of Search ..... 149/222, 525, 149/565, 586, 633, 637, 711, 712, 713, 660–663; 219/121.59

[56] References Cited

U.S. PATENT DOCUMENTS

| | | | |
|---|---|---|---|
| 2,890,975 | 6/1959 | Lenz | 148/660 |
| 3,503,787 | 3/1970 | Pendse | 148/222 |
| 3,928,090 | 12/1975 | Randerson | 148/662 |
| 4,121,954 | 10/1978 | Dewsnap et al. | 148/660 |
| 4,317,984 | 3/1982 | Fridlyand | 219/121.59 |
| 4,500,564 | 2/1985 | Enomoto | 148/222 |
| 4,551,183 | 11/1985 | Tamm et al. | 148/660 |
| 4,872,926 | 10/1989 | Giacobbe | 148/565 |
| 4,900,371 | 2/1990 | Dexter et al. | 148/565 |

FOREIGN PATENT DOCUMENTS

| | | | |
|---|---|---|---|
| 62550 | 10/1982 | European Pat. Off. | 148/222 |
| 2-232354 | 9/1990 | Japan | 148/222 |
| 4-52265 | 2/1992 | Japan | 148/222 |

OTHER PUBLICATIONS

Translations (informal and not certified) obtained by Applicants enclosed herewith.

J. Pelletier and Y. Arnal, "New Application for Multipolar Plasmas: High–Temperature treatment of materials" Oct. 1984 American Institute of Physics, pp. 1636–1638.

R. Holoboff, B. Lhote, R. Speri and O. Delcourt "Vacuum Quenching Improvements through Controlled Atmospheres" 22–25 Sep. 1992 Proceedings of the First International Conference on Quenching & Control of Distortion. pp. 113–116.

E. J. Radcliffe, "Gas Quenching in Vacuum Furnaces—a Review of Fundamentals" Nov. 1987 pp. 34–39.

*Primary Examiner*—George Wyszomierski
*Attorney, Agent, or Firm*—V. D. Duraiswamy; W. K. Denson-Low

[57] ABSTRACT

A workpiece is heated by first forming an ionized gas plasma around the workpiece. A positive potential is applied to the workpiece to accelerate electrons from the plasma into the workpiece. The workpiece is uniformly surface heated by the energy directed into the workpiece by the electrons. The workpiece is cooled by providing a flow of a pressurized liquid material such as carbon dioxide having a triple point. The liquid material is expanded through a nozzle to form solid particles that contact the surface of the workpiece and remove heat from it by subliming.

8 Claims, 5 Drawing Sheets

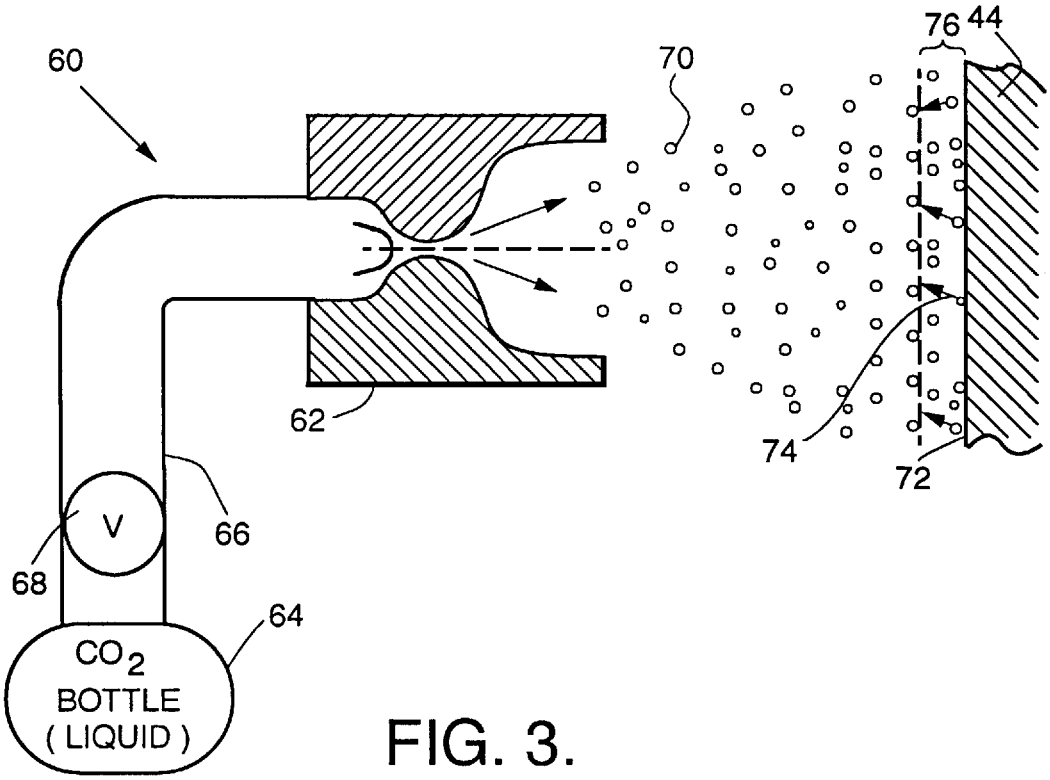
FIG. 3.
FIG. 4.
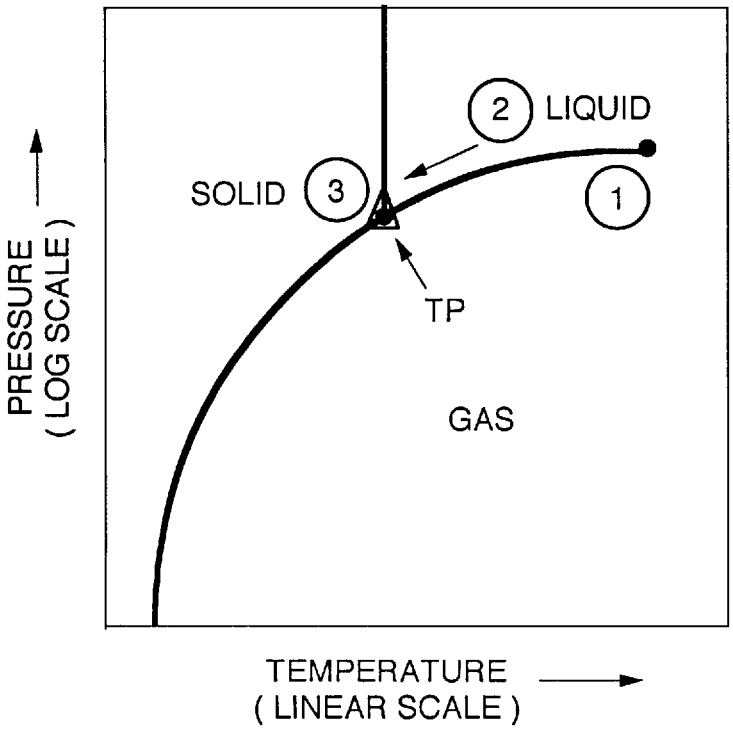

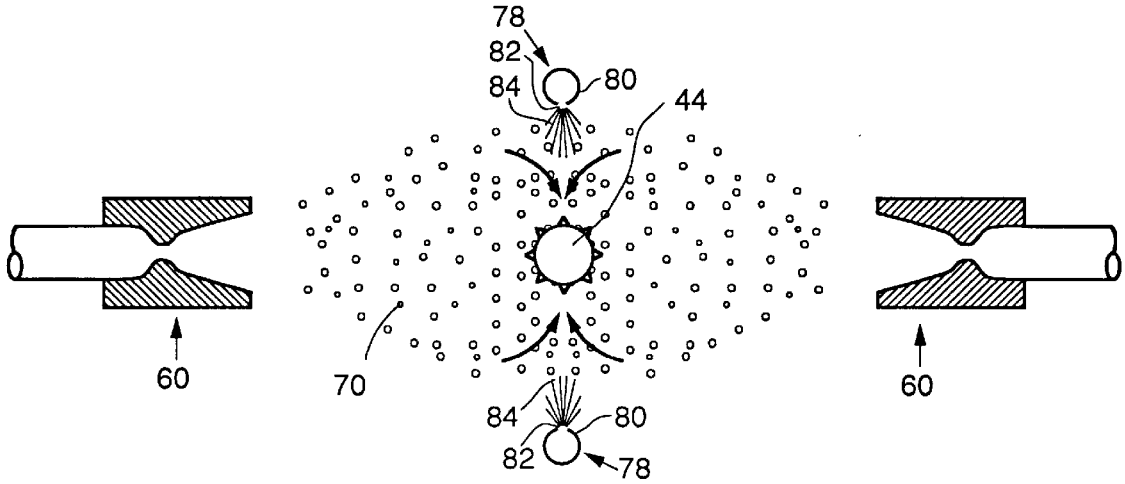
FIG. 5.
FIG. 7.
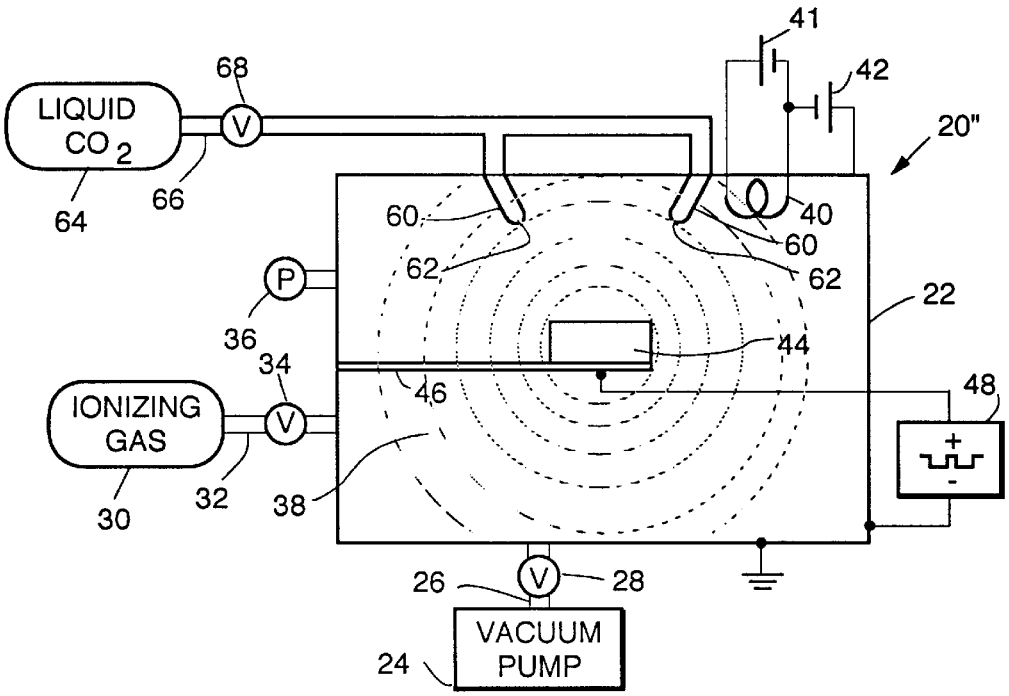

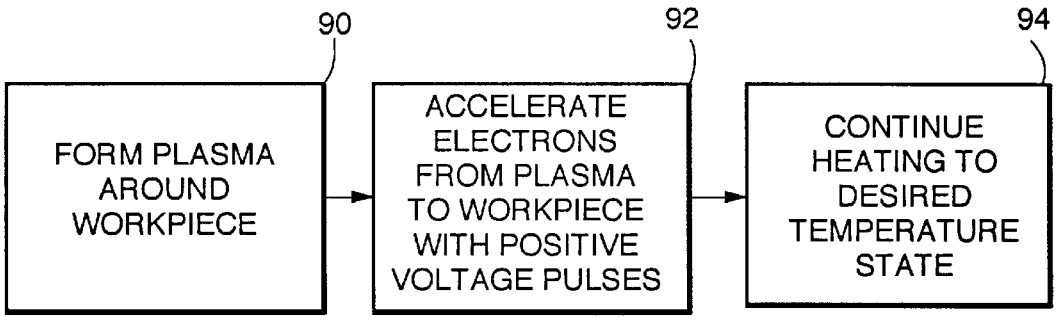
FIG. 8.
FIG. 9.
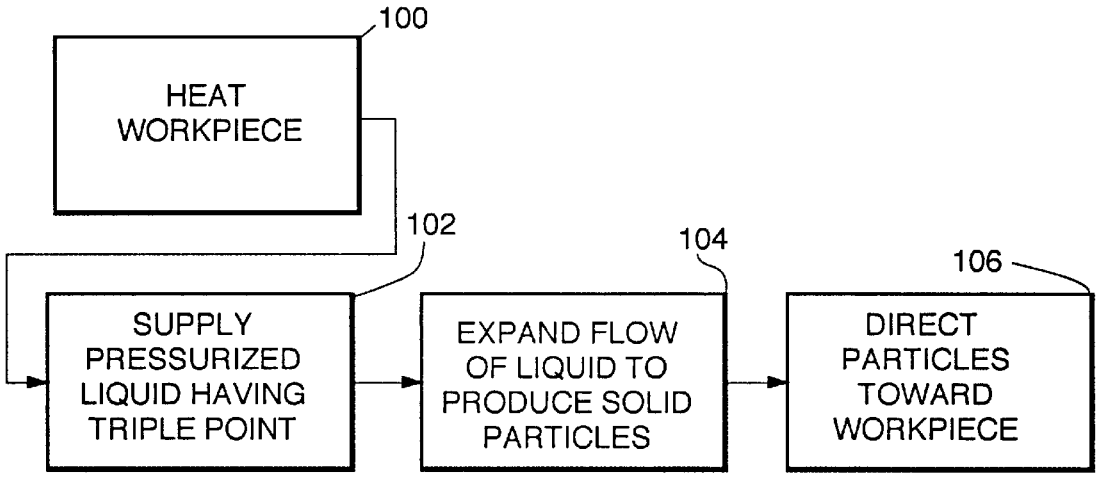
FIG. 10.
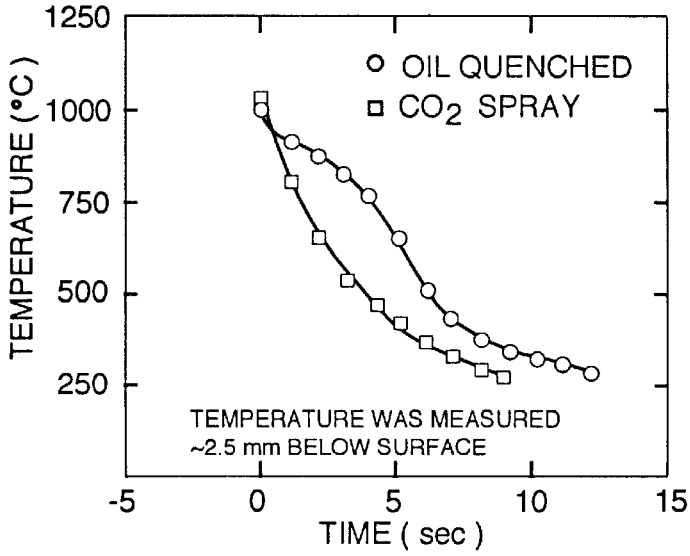

HEAT TREATMENT BY PLASMA ELECTRON HEATING AND SOLID/GAS JET COOLING

BACKGROUND OF THE INVENTION

This invention relates to the heat treating of materials, and, more particularly, to techniques for rapidly and selectively heating and cooling in production heat treatment operations.

One of the most important characteristics of many commercial metallic alloys is their capacity for property modification by heat treatment. The basis of heat treatment is the existence of various strength modifying mechanisms such as precipitation hardening and phase transformations such as the formation and modification of martensites. Workpieces made of such alloys may be modified throughout their volumes or only at their surfaces, as needed for particular applications. From a knowledge of the various mechanisms, the properties of such alloys may be modified over wide ranges by the choice of a heat treatment.

Heat treatment generally involves controlled heating and cooling of a workpiece. The result of the heat treatment of a workpiece of a particular composition depends upon a number of parameters such as the temperatures selected, heating and cooling rates, times at temperatures, the use of multiple heating and cooling steps and cycles, and other process parameters.

Some of the commercially most important heat treatments are performed to modify only the surface regions of the workpiece. For example, many steels are specially treated to preferentially harden their surfaces to improve their wear resistance, while maintaining an interior of high toughness and fracture resistance. Where only the surface of the workpiece is to be treated, the depth of penetration of the heated and cooled region into the workpiece and the temperature profiles during the heat treatment are of particular concern. These parameters are often determined at least in part by the shape of the workpiece and the presence of irregularities such as sharp points or recesses at its surface.

Because heat treatment is so important to the most desirable utilization of many materials, many different types of heat treatment apparatus and methods have been developed. One commonly used approach is to heat the workpiece in a furnace heated by gas or electrical elements. After the workpiece has been at the required temperature for the required time, it may be cooled at any of several cooling rates, ranging from very slow furnace cooling to gas cooling to a rapid water quench. This technique processes the entire object at once, but can be very inefficient due to the slow heatup and/or cooling of the workpiece.

In another heat treating approach, a heating beam such as a laser or an electron beam is directed at the surface of the workpiece to heat it rapidly. The surface may instead be induction heated. These techniques are efficient in that they do not heat the workpiece, but they require that the beam or induction coil be moved over the surface of the workpiece. This stepping action can be slow and may result in variability in the heat treatment as a function of location, particularly where there are surface irregularities on the workpiece. Plasma heating has also been tried, but it has not produced rapid heating rates.

The cooling of a workpiece during surface treatments poses similar difficulties. If the workpiece is heated uniformly, rapid cooling is normally achieved by immersing the workpiece in a cooling medium such as water or oil. On the other hand, if the heating source must be stepped over the surface of the workpiece, it is difficult to achieve a uniform, controllable cooling.

There is a need for an improved approach to the heat treating of materials. This need is particularly acute where the heat treatment is a surface heat treatment or where relatively rapid cooling is required, either uniformly over the entire surface of the workpiece or selectively over specific areas of the workpiece. Such treatments are widely utilized in industrial operations. The present invention fulfills this need, and further provides related advantages.

SUMMARY OF THE INVENTION

The present invention provides methods and apparatus for heat treating metals and other workpieces. The approach permits rapid, controllable heating that is particularly suitable for surface heat treating. The workpiece is heated uniformly over its entire periphery or selectively over specific areas, even in the presence of significant surface irregularities. The heating procedure is highly efficient, since only the workpiece is heated. Multiple workpieces can be heat treated to different temperatures at the same time and in the same chamber. Cooling according to the invention is accomplished without immersing the workpiece into any quenching medium. The workpiece is cooled at a higher rate than possible by high-pressure gas cooling or oil immersion, and there is no residue left on the workpiece. The surface of the workpiece can be cooled uniformly over its entire surface, or selectively in specific areas.

In accordance with the invention, an apparatus for heat treating a workpiece comprises a vacuum chamber, means for controllably evacuating the vacuum chamber, and means for controllably supplying a partial pressure of an ionizing gas to the interior of the vacuum chamber. There is means for providing a plasma within the vacuum chamber. Heating is accomplished by means for applying a pulsing positive voltage to the workpiece relative to the plasma, so that electrons are accelerated from the plasma into the workpiece. The means for applying a pulsing positive voltage operates independently of the means for providing a plasma. The workpiece is held on an electrically isolated support in a position to be plasma electron heated. There is no need to manipulate the workpiece.

In a corresponding process, a method of heat treating a workpiece comprises the steps of forming a plasma of an ionizing gas around the workpiece, and accelerating electrons from the plasma to the workpiece with a series of pulses of positive voltage, relative to the plasma, applied to the workpiece to heat the workpiece. The step of accelerating is continued until a preselected state of heat treatment has been reached in the workpiece.

The plasma created by the plasma source surrounds the workpiece, and provides a reservoir of electrons on all sides of the workpiece. The applied pulsed positive voltage of the workpiece relative to the plasma extracts electrons from the plasma to the workpiece. The voltage accelerates the electrons, and upon impacting the workpiece the energy of the electrons is transferred to the workpiece to heat it. Since the electrons come from the plasma that completely surrounds the workpiece, the workpiece is heated on all sides from its surface and therefore need not be manipulated during the treatment. This approach is particularly advantageous where only the surface of the workpiece need be heated, and the heating is to be uniform. In another approach, the surface of the workpiece can be masked to achieve uniform heating of selected (unmasked) areas.

The heat treating approach also extends to cooling of the workpiece. Further in accordance with the invention, apparatus for heat treating a workpiece comprises a support adapted to receive the workpiece to be heat treated. A nozzle means expands a flow of a liquid from a higher pressure to a lower pressure and directs the expanded flow toward a location of the workpiece when it is held on the support. There is a pressurized source of a liquid material having a thermodynamic triple point of equilibrium between its liquid, solid, and gaseous forms, and a conduit controllably extending from the source of the liquid material to a higher pressure side of the nozzle means. The liquid material is preferably pressurized carbon dioxide, but argon, nitrogen, and other suitable gases can also be used.

In a related method, a method of heat treating a workpiece comprises the steps of heating the workpiece and directing a flow of solid particles at the workpiece. The flow is produced by the steps of supplying a pressurized liquid material having a thermodynamic triple point of equilibrium between its liquid, solid, and gaseous forms, expanding a flow of the liquid material from a higher pressure to a lower pressure to produce small clusters of solid particles of the material, and directing the expanded solid flow toward the workpiece.

When the pressurized liquid material is expanded through the nozzle, it cools and transforms to the solid state. Small particles of the transformed solid penetrate through boundary layers and other obstacles at the surface of the workpiece. These particles absorb heat from the workpiece, and transform at the reduced pressure to the gaseous state. The gases leave the vicinity of the workpiece, allowing more solid coolant to reach the surface. The cooling by this approach has a higher rate than (corresponding gas cooling or oil quenching approaches because the limitations of boundary layers and film boiling phenomena on the heat transfer coefficient are overcome. The particles of the solid coolant can be directed to a specific area of the surface to selectively cool that area, or they can be distributed everywhere around the periphery of the workpiece to achieve spatially uniform cooling, by using multiple nozzles and/or solid distributing techniques. Thus, for most applications manipulation of the workpiece is not required.

The heating and cooling approaches of the invention may be used together or separately with other cooling and heating techniques, respectively.

The approaches of the invention provide an important advance in the art of heat treatment. They permit articles to be heat treated in vacuum and cooled in a generally inert, low pressure atmosphere without contamination that must be later removed. Other features and advantages of the present invention will be apparent from the following more detailed description of the preferred embodiment, taken in conjunction with the accompanying drawings, which illustrate, by way of example, the principles of the invention.

BRIEF DESCRIPTION OF THE DRAWINGS

FIG. 3 is a schematic view of a solid/gas jet cooling (SGJC) apparatus;

FIG. 4 is a graph of the pressure-temperature phase diagram of carbon dioxide;

FIG. 5 is an elevational view of a solid/gas jet cooling apparatus with solid particle dispersing;

FIG. 7 is a schematic view of a heat treating unit that utilizes both plasma electron heating and solid/gas jet cooling (SGJC);

FIG. 8 is a block process flow diagram for the heating of the workpiece by plasma electron heating;

FIG. 9 is a block process flow diagram for the cooling of the workpiece by solid/gas jet cooling (SGJC); and FIG. 10 is a graph of temperature as a function of time for workpieces cooled by different techniques.

DETAILED DESCRIPTION OF THE INVENTION

Figure 1:
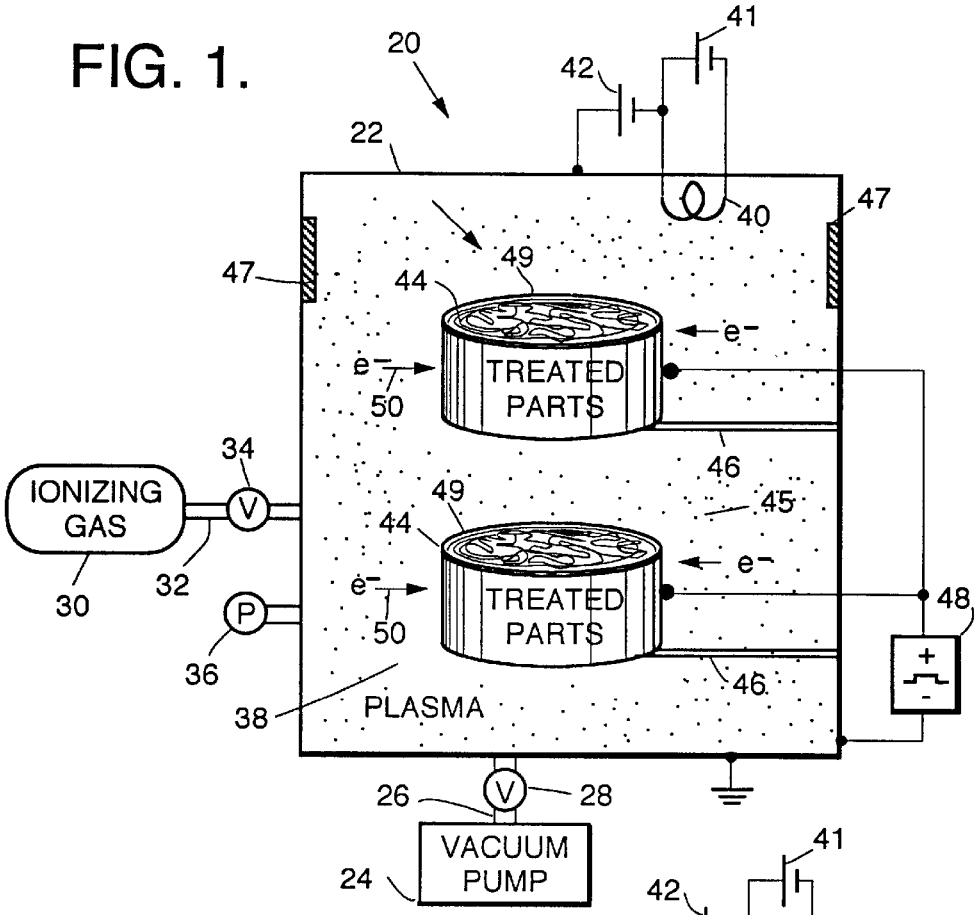
FIG. 1 is a schematic view of a plasma electron heating apparatus.

FIG. 1 depicts a plasma electron heating apparatus 20. The apparatus 20 includes a vacuum chamber 22 that is evacuated by a vacuum pump 24 through a conduit 26 having a controllable gate valve 28. An ionizing gas such as nitrogen is supplied to the interior of the vacuum chamber 22 from an ionizing gas source 30 through a conduit 32 having a controllable valve 34. A pressure gauge 36 measures the pressure within the vacuum chamber 22. In operation, the vacuum chamber 22 is evacuated by the vacuum pump 24 with the gate valve 28 fully open. The gate valve 28 is then partially closed and the controllable valve 34 is partially opened to admit a partial pressure of the ionizing gas. The pressure measured by the gauge 36 is observed, and the partial pressure of ionizing gas is maintained at a selected level by coordinating the relative flows through the valves 28 and 34.

A plasma 38 is created which fills the interior of the vacuum chamber 22, by any suitable approach. In FIG. 1, an exposed hot wire filament 40 is positioned in the interior of the vacuum chamber 22. The filament is electrically isolated from the walls of the vacuum chamber 22. The filament 40 is heated to thermionic temperatures using a power supply 41 connected across the leads of the filament. The ionizing gas is ionized using a power supply 42, which has its negative pole connected to one lead of the filament 40 and its positive pole connected to the vacuum chamber walls 22. The filament 40 is therefore the cathode and the vacuum chamber 22 is the anode for forming the plasma 38. The gas molecules are ionized by electrons emitted from the filament 40, producing a plasma comprised of equal numbers of free electrons and positively charged gas ions. The plasma that is produced diffuses to completely fill the interior of the vacuum chamber 22, thereby immersing any workpiece within the plasma. The plasma that is produced is at the potential of the vacuum chamber walls, which are at ground potential.

As shown, two workpieces 44 rest on electrically insulating supports 46 in the vacuum chamber 22. The supports are covered with shielding to protect them from the plasma that fills the chamber. The free electrons and gas ions of the plasma 38 surround the workpieces 44, with a plasma sheath 45 whose dimensions are dependent upon the properties of the plasma such as gas pressure, plasma density, and electron temperature. The apparatus 20 is suitable for treating one or more workpieces at a time, and two workpieces are shown for illustration. The plasma may be produced from multiple filaments, and may be tailored or shaped using known techniques for manipulating plasmas. Specifically, magnets 47 placed within the interior of the vacuum chamber 22 can be used to shape the plasma for specific applications. The plasma density and plasma electron temperature can be adjusted by varying the gas pressure, filament temperature, and/or electron energy. The apparatus shown in FIG. 1 can be scaled to any required size in order to treat any size or number of parts.

A bipolar pulsing power source 48 is connected at its positive pole to the workpieces 44, and at its negative pole to the walls of the vacuum chamber 22. In this case, both workpieces are pulsed with the same voltage and waveform. The walls of the vacuum chamber 22 are grounded, as is the plasma 38 surrounding the workpieces.

When the workpieces 44 are pulsed to a positive voltage relative to the plasma 38, the plasma becomes a cathode with respect to the workpieces, which are each an anode. The anode workpieces 44 are separate and distinct from the vacuum chamber anode 22 used to create the plasma 38. The applied positive voltage develops across the plasma sheath 45, so that free electrons from the plasma are accelerated to the workpieces, as indicated at numeral 50. The energized electrons impact the workpieces 44, and their energy is transferred to the workpieces 44.

The electrons penetrate into the workpieces only a small distance, which is dependent upon the applied voltage and the material of the workpieces. In most cases the penetration is at most a few micrometers. Only this surface region of the workpiece is heated directly, although the underlying regions are heated by thermal diffusion from the surface regions.

The plasma electron heating can be conducted in two different and distinct modes. The first mode consists of rapid, burst heating to achieve rapid and preferential heating of the surface of the workpiece without significantly heating the interior of the workpiece. The second mode consists of a slow, continuous heating to achieve both surface and interior heating of the workpiece. In either heating mode, manipulation of the workpiece is not required.

An important advantage of plasma electron heating for either mode is that heating is not dependent upon the surface properties of the workpieces. A further important advantage is that the heating is uniform around the entire periphery of the workpieces, even including most types of surface irregularities. The uniform heating results from the plasma sheath 45 which envelops the workpieces. By tailoring the plasma properties, the plasma sheath can be made to conform to many distinct surface irregularities of the workpiece. Because of this conformal feature of the plasma sheath, electrons are provided from all sides of the workpieces, not just from a single fixed location as in conventional electron beam heating.

For the rapid, burst heating mode, the surface heating is nearly independent of the thermal mass of the workpiece. For either operating mode, the heating of the workpieces by the plasma electron bombardment is also independent of furnace components such as heaters and insulation, if such components are used in conjunction with the present invention.

As an alternative to the uniform heating of the entire surface of the workpiece 44, the plasma electron heating process can be utilized in a manner that allows for preferential heating of specific areas of the workpiece surface. To accomplish this result, those surfaces of the workpiece 44 that are not to be heated are covered with a mask of an operable material such as a removable insulating coating or a metallic foil that is loosely placed on the workpiece surface to ensure poor thermal contact with the workpiece surface. For example, in FIG. 1 the ends of the generally cylindrical workpieces 44 are shown as being covered with a foil mask 49, so that electrons cannot penetrate those surfaces. Heating is thereby selectively accomplished only on the curved side surfaces of the cylinders, which are exposed to the plasma 38. The mask can be patterned, so that only a small portion of a large covered surface is exposed to the plasma and heated.

The plasma that surrounds the workpiece includes positively charged gas ions, negatively charged electrons, and un-ionized gas. In the typical low-pressure ($10^{-4}$–$10^{-5}$ Torr) plasma that is preferred, the ion-to-neutral-gas atom fraction is typically 1–10 percent. The plasma is therefore predominantly neutral, un-ionized gas atoms. These gas atoms impinge upon the workpiece from all directions uniformly, since they are not repelled by the voltage applied to the workpiece.

By proper selection of the ionizing gas, the impingement of the un-ionized gas can be utilized to attain other advantageous results simultaneously with the plasma heating process. Argon is chemically inert, and its use as the ionizing gas provides only the capability to plasma electron heat the workpiece. Nitrogen, on the other hand, can form nitrides in steel. The use of nitrogen as the ionizing gas can result in not only heating but also formation of a hard nitride layer at the surface of the workpiece. This type of surface nitriding is distinct from conventional plasma nitriding in that there is no ion bombardment of the workpiece surface.

The heating of the workpieces by the plasma electron heating apparatus can continue as long as necessary to achieve the desired heated state in the workpiece. For surface treatments, it is necessary only to heat the surface of the workpiece for the time required to reach a preselected temperature and/or achieve a preselected microstructural state. If through-thickness heat treatment is desired, the heating can continue until the internal temperature state is reached by thermal diffusion. Extended periods of electron heating are not damaging to the material, as the positive ions in the plasma are repelled from the workpieces.

Typical operating conditions for the plasma electron heating apparatus 20 are an ionizing gas pressure of from about $10^{-5}$ to about $10^{-4}$ Torr. For gas pressures below about $10^{-4}$ Torr, the full applied voltage provided by the power supply 48 is sustained across the plasma sheath 45 surrounding the workpiece. This allows the plasma electrons to bombard the workpiece surface with the full applied voltage to efficiently heat the surface. However, for pressures above about $10^{-4}$ Torr, the applied voltage cannot be sustained across the plasma sheath surrounding each part. The plasma electrons cannot bombard the workpiece surface with the full applied voltage, and minimal heating of the surface results so that the process is less efficient.

In the preferred approach, the power source 48 is pulsed at a rate of from about 10 Hertz to about 3000 Hertz, with each pulse lasting from about 1 to about 50 microseconds. The voltage applied to the workpieces is from about 1 kilovolt to about 100 kilovolts. The pulses may be in the form of a continuous pulse train, or they can be provided in short-duration bursts of short-duration pulses. A typical short-duration burst would be from about 0.1 to about 3 seconds, and would contain about 100–5000 pulses, each pulse of width about 10–30 microseconds. These values are not limiting of the invention, but are intended to be exemplary of preferred operating conditions.

The use of a pulsed accelerating voltage applied to the parts 44 is to be distinguished from the use of a constant or DC voltage applied to the parts. Pulsing permits high voltages of 50–100 kilovolts to be applied to an anode workpiece to achieve preferential surface heating or slow, through-thickness heating. A 50–100 kilovolt DC voltage cannot be sustained across the plasma sheath 45 of a workpiece operated at an anodic potential. Furthermore, arcing would result, which can damage the surface of the part. By way of contrast, a 50–100 kilovolt pulse can be sustained across the plasma sheath of a workpiece operated at an anodic potential, but only at the pressures stated herein.

With the use of pulsing, care is taken to select the positions of the parts 44 in relation to each other and the walls of the vacuum chamber. During each pulse, the plasma sheath expands, and during the off time between pulses the sheath contracts back to its original size. To maintain good conformal electron bombardment of the parts, the parts should be placed in the vacuum chamber such that adjacent sheaths do not overlap during a pulse. For the typical 1–50 microsecond pulse widths, the sheath does not expand to a dimension of more than about 6 centimeters. The use of longer-duration applied voltage pulses would result in larger sheath sizes, limiting the manner in which parts are closely packed in the apparatus during heat treatment. Longer duration voltage pulses provided by the power supply 48 also would adversely affect the conformality of the sheath and the plasma and would prevent the conformal treatment of parts having surface features finer than the plasma sheath dimension.

Figure 2:
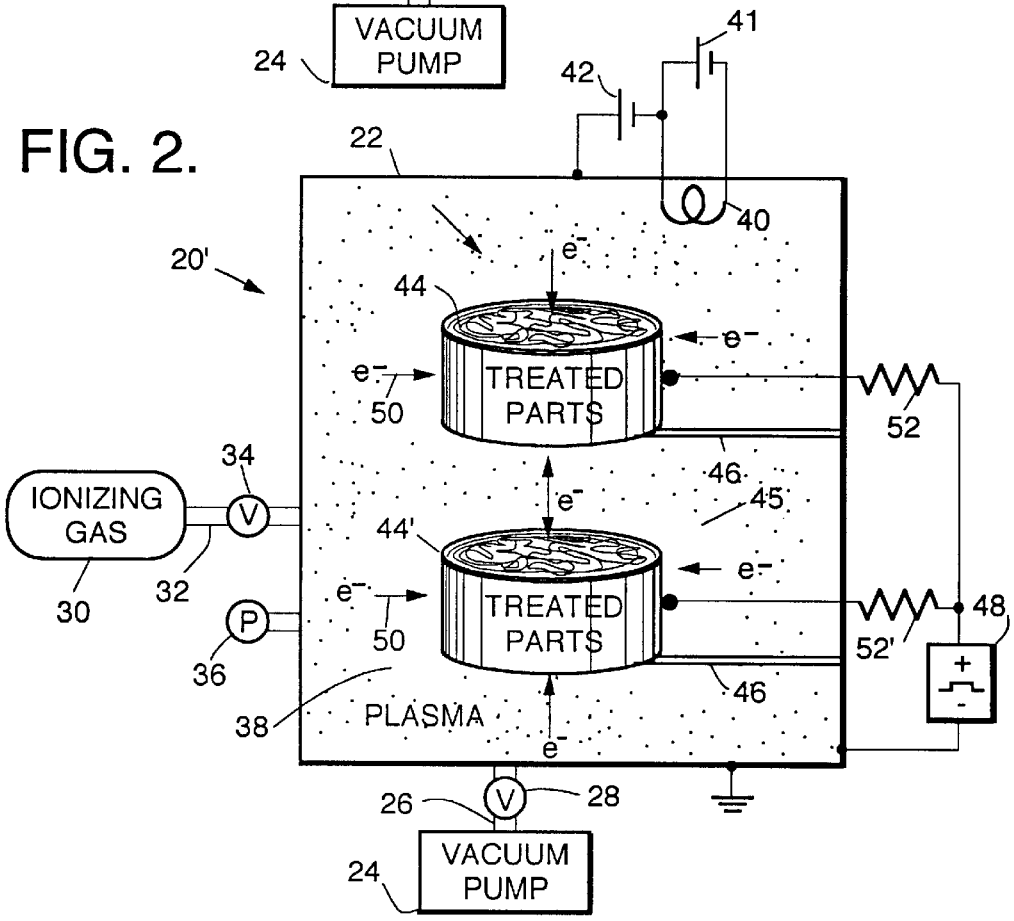
FIG. 2 is a schematic view similar to that of FIG. 1, showing the heat treatment of multiple workpieces to different heat treatments in a single operation.

FIG. 2 depicts a variation of the apparatus 20, a plasma electron heating apparatus 20'. The apparatus 20' primarily utilizes components like those of the apparatus 20. Corresponding components have been numbered in FIG. 2 as in FIG. 1, and the prior description is incorporated here. (In FIG. 2, the end masks 49 have been omitted, so that the plasma electron heating occurs over the entire surface of the workpiece, to illustrate this possibility.)

A difference between the apparatus 20' and the apparatus 20 is that workpieces 44 and 44' are heated differently in the two cases. A single power source 48 is used, but its positive side is connected to the workpieces 44 and 44' through ballast resistors 52 and 52', respectively, of different resistances. The effective positive voltages applied to the workpieces 44 and 44' are therefore different. As a result, the energies of the electrons accelerated into the workpieces 44 and 44' are different, so that the respective workpiece surfaces are heated differently.

It is therefore possible to heat treat the workpieces 44 and 44' differently in a single operational run of the apparatus 20'. Because the walls of the vacuum chamber are not heated except incidentally, and there are no resistance-type heating elements, multiple types of simultaneous heat treatments in the same chamber are readily conducted. This principle can be extended to the use of multiple power sources 48, the use of switching arrangements to further control the heating, or the use of capacitors and inductors to replace the ballast resistors, for other heat treatments in a single chamber and a single operational run. This capability is an advantage of the invention, allowing more complete and economical utilization of the apparatus and less interruption to work schedules. Thus, for example, in some businesses where small numbers of parts must be specially heat treated, it is sometimes the practice to delay the heat treating of each type of part until a full furnace load can be accumulated. The present approach permits different types of heat treatments to be accomplished at once, avoiding the need for such delays.

It has been found advantageous to use a low voltage (e.g., 20 kilovolt) and either a continuous or rapid burst mode heating of the workpiece prior to conducting the actual heating of the workpiece surface in order to clean or desorb any residue or films that are present on the workpiece prior to its treatment. This pre-cleaning process has been found to be beneficial in preventing arcing during the subsequent plasma electron heat treatment of the workpiece. Typically, the pre-cleaning procedure takes about 5 minutes, depending upon the degree of cleaning desired.

The plasma electron heating modes and techniques that have been described can be used with or without the addition of a separate forced cooling process to cool the heated workpiece. No manipulation of the work piece is required in either case. In the case where no separate, forced cooling is employed, the workpiece is cooled by two distinct modes. In the first, rapid self-quenching of the workpiece is achieved after rapid, burst-mode heating of the workpiece surface. In this case, the surface is cooled by conduction to the interior of the workpiece. In the second mode, slow radiative cooling of the surface is achieved after slow, continuous heating of the workpiece that heats both the surface and the interior of the workpiece.

Where a separate forced cooling process is used in conjunction with the plasma electron heating modes, cooling of the workpiece is achieved after the desired temperature and/or microstructural state of the workpieces has been obtained. For example, if relatively rapid cooling of workpieces is performed, particularly in ferrous metallurgy, a particular phase transformation can be suppressed or particular phases can be formed, depending upon the rate of cooling.

Specifically, it is often desirable to cool the surface of the vacuum-heated workpiece relatively rapidly. In conventional practice, a workpiece heated in a vacuum by radiation, for example, is cooled at a relatively high rate by high pressure gas cooling. In this approach, the vacuum chamber is rapidly backfilled, typically in 10–20 seconds, with a gas such as helium to a pressure of 1–20 atmospheres. The cooling gas contacts the surface of the workpiece and carries away heat. The heat removal rate is usually limited by a boundary layer at the surface of the workpiece, and the convection of the cooling gas.

The present invention provides an alternative approach to cooling the vacuum-heated workpieces, termed solid/gas-jet cooling ("SGJC"). FIG. 3 illustrates a solid/gas-jet cooling apparatus 60. The apparatus 60 includes a converging/diverging nozzle 62 that expands a high-pressure flow that is input to the nozzle.

The apparatus 60 further includes a source 64 of a liquid material having a thermodynamic triple point of equilibrium between its liquid, solid, and gaseous forms. The liquid material is preferably the heteroatomic species liquid carbon dioxide ($CO_2$), which can exist as a liquid in a pressurized state. At one atmosphere pressure, carbon dioxide exists only as a gas or a solid ("dry ice"). The liquid material is conveyed from the source 64 to the nozzle 62 through a conduit 66 having a controllable valve 68 therein. The valve 68 permits a controllable flow of the liquid material to pass to the nozzle 62. The valve may be actuated manually or remotely, and may be placed near the source 64, depending upon the system design and system performance that is desired. Other liquid materials that may be used include diatomic species such as nitrogen and noble species such as argon.

FIG. 4 schematically illustrates the pressure-temperature phase diagram for the liquid material having a triple point equilibrium between solid, gas, and liquid. The material is stored in the source 64 under pressure. In the preferred case, the carbon dioxide is stored in the liquid state at a pressure of about 835 pounds per square inch (psi). As a liquid, the carbon dioxide can flow along the conduit 66, and the flow rate can be readily controlled by the valve 68.

As the liquid carbon dioxide expands through the diverging portion of the nozzle, its pressure and temperature are reduced. The liquid carbon dioxide transforms to a solid as it passes into the solid phase region of the phase diagram. Small, snow-like particles 70 of solid carbon dioxide are formed downstream of the nozzle 62. Depending upon the operating conditions, the particles may be as small as 1000 molecules in size or may be much larger.

The small carbon dioxide particles 70 travel through free space and impact upon a surface 72 of the workpiece 44. The solid carbon dioxide snow absorbs heat from the surface 72 and is vaporized by sublimation. Carbon dioxide molecules diffuse away from the surface, as indicated schematically at numeral 74, carrying the heat of the workpiece 44 with them. Because the liquid carbon dioxide cannot exist thermodynamically at one atmosphere pressure, there is no liquid remaining on the surface following the cooling treatment, an important advantage.

The solid/gas-jet cooling technique has been found to give superior results to ordinary high pressure gas cooling for several reasons. First, each carbon dioxide particle absorbs not only the heat required to increase its temperature, but also the heat of sublimation as it transforms to the vapor phase. Thus, its effective heat capacity is greater than that of a molecule that always remains in the gaseous phase. Second, during cooling a boundary layer 76 of heated gaseous molecules develops immediately adjacent to the surface 72. It is difficult to force other gaseous molecules through this boundary layer from the outside, resulting in a decreased surface heat transfer coefficient when high pressure gaseous cooling is used. The relatively massive solid particles 70 can easily penetrate through the boundary layer 76 to reach the surface 72, avoiding the adverse effects of the boundary layer upon the heat transfer coefficient.

The fraction of solid particles entrained in the flow of particles from the nozzles can be tailored for advantageous results. By adjusting the temperature or pressure of the source 64, the entrained flow can be made to be predominantly solid particles or predominantly gas. A temperature of the source of 70° F. or below results in predominantly solid particles and a temperature about 90° F. results in predominantly gaseous particles produced upon expansion through the nozzle 62. The fraction of gas and solid particles can be controlled by adjusting the pressure within the carbon dioxide bottle source 64. The fraction of gas and solid particles can also be controlled directly by diluting the solid-gas stream with the addition of more gas. The dilution can be accomplished by two different methods. In the first method, an aerosol is formed in the liquid phase by injecting a dissimilar gas directly into the conduit 66, the liquid phase of the cooling gas. The second method dilutes the solid entrained in the gas stream with more gas of the same species at nozzle 62. Cooling of the workpiece can also be controlled by simultaneously passing different gases through different nozzles and directing the resulting solid/gas mixture flows against the workpiece. Cooling of the workpiece can also be controlled by varying the location and/or orientation of the nozzle or nozzles with respect to the workpiece.

One of the characteristics of the plasma electron heating technique is that it can be used to uniformly heat an entire workpiece surface or uniformly heat only selective areas of the workpiece without manipulation of the workpiece. Similarly, the SGJC process can be used to uniformly cool the entire workpiece surface or uniformly cool selected areas of the workpiece surface, also without manipulation of the workpiece. The SGJC nozzle-based cooling technique can be used to selectively cool specific areas of a workpiece by using a plurality of nozzles aimed at different areas and possibly operating with different operating conditions and/or coolant materials. Alternatively, selective cooling may be achieved by masking specific areas of the workpiece.

SGJC is a low-pressure cooling process. The vacuum chamber is continuously pumped by the vacuum pump. During SGJC, the chamber pressure is increased by the cooling gas, but the valve 28 may be throttled to maintain a selected vacuum that is typically in the range of 100 micrometers to 1 atmosphere. Alternatively, the vacuum valve 28 can be closed during cooling to permit the interior of the vacuum chamber to be pressurized by the cooling gas. A vent or relief valve can optionally be provided to prevent pressurization above a preselected level such as one atmosphere.

In some instances, cooling of a single surface is preferred. In other instances, it is preferred to achieve more omnidirectional cooling of the entire workpiece surface.

A modification of the SGJC apparatus 60 that achieves more nearly spatially uniform cooling is shown in FIG. 5. To cool a workpiece 44 on all sides, two or more of the SGJC apparatus 60 are arranged at various locations around the workpiece. These SGJC apparatus 60 direct a flow of particles 70 at the workpiece 44. The number, cooling medium, and operating parameters of the various SGJC apparatus 60 can be adjusted as necessary.

A variation of this technique uses dispersing jets 78 (shown in FIG. 5) provided at various locations relative to flows from the nozzles of the SGJC apparatus 60. The dispersing jets 78 are conduits 80 having apertures 82 therein directed inwardly toward the workpiece 44.

Pressurized gas streams 84 of the same (or a different) gas flowing in the conduit 82 escape inwardly toward the workpiece 44 through the aperture 82, and force particles 70 toward the sides of the workpiece that are otherwise not as accessible to the SGJC apparatus 60. In practice, since it is usually desirable to reach all sides of the workpiece 44, the conduits 80 may be made part of a single toroidal conduit, whose remaining portions are out of sight in the view of FIG. 5. Other shapes of the conduits 80 can be devised for achieving spatially uniform cooling of other shapes of workpieces, as necessary. Any combination of SGJC apparatus 60, operating in the same or different operating conditions, and dispersing jets 78 can be used as needed for a particular cooling requirement.

Figure 6:
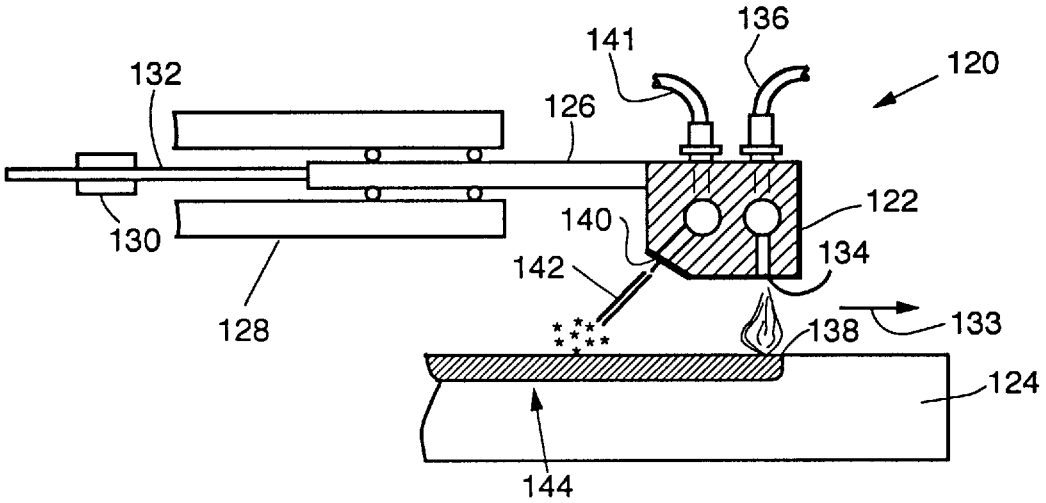
FIG. 6 is a schematic sectional view of an apparatus for heat treating a workpiece in air with solid/gas jet cooling (SGJC)

FIG. 6 shows another utilization of the SGJC technique. Some types of workpieces are typically heated in air, as for example by flame heating or induction heating, and then rapidly cooled to form a hard surface layer of martensite or other phase. The SGJC technique can be employed to advantage in such processes using an apparatus 120 such as that shown in FIG. 6.

The apparatus 120 includes a heat treating head 122 that is movable with respect to a workpiece 124. In the illustrated case, the heat treating head 122 is movable and the workpiece 124 is stationary, but this could be reversed. Here, the heat treating head 122 is supported on an arm 126 from a drive structure 128. The drive structure 128 includes a drive motor 130 that moves the arm 126, and thence the heat treating head 122, via a drive arm 132. In the illustrated embodiment, the heat treating head 122 is moved to the right, as indicated by the arrow 133.

The heat treating head 122 includes a flame hardening nozzle 134 through which a flammable gas from a source line 136 is passed. The flammable gas, such as acetylene, is burned at the outlet of the nozzle 134. The resulting flame heats a surface 138 as the heat treating head 122 is passed over the surface 138.

The heat treating head 122 also includes a SGJC nozzle 140 operating in the manner discussed previously in relation to the SGJC apparatus 60. A liquefied gas from a source line 141 is passed through the nozzle 140 and expands to produce a flowing stream 142 that may be a mixture of solid particles and gas. The nozzle 140 is directed so that the flowing stream impinges upon the surface 138 of the workpiece 124 a short distance behind the flame of the nozzle 134. The SGJC stream 142 thereby quenches the surface 138 of the workpiece 124 to produce a heat treated, quench-hardened zone 144. An alternative to the motorized movement shown in FIG. 6 is to manually manipulate the nozzle head 122.

The approach of FIG. 6 has the same advantages over prior techniques as discussed previously. It requires no cleanup of the surface, as compared with oil or water quenches. It uses non-hazardous quenchant materials, and the workpiece need not be moved.

The quench rate using the SGJC approach is superior to that of an oil quench. In a series of studies, an apparatus 120 using the SGJC quench approach to quench 5130 steel plugs achieved Rockwell-C hardnesses of 57–60. By contrast, a comparable apparatus using an oil quench achieved Rockwell-C hardnesses of only 52–53.

FIG. 7 depicts an apparatus 20" that is similar to the apparatus 20 and 20' discussed previously in relation to FIGS. 1 and 2, except that both plasma electron heating and solid/gas-jet cooling are incorporated into the same heat treating system. Corresponding components have been assigned the same numbering as in the prior discussion, and that discussion is incorporated here. Since all of the components and their functions have been discussed previously, no further description is required. In the illustrated case, two of the SGJC apparatus 60 are used, and they are aimed at a single surface of the workpiece 44. In this example, only that surface is to be rapidly cooled. In operation of the apparatus 20", the workpiece 44 is heated by the plasma electron heating components in the manner previously described. After the required heating temperature and time have been achieved, the plasma electron heating is discontinued. The SGJC cooling using the nozzles 62 is then commenced, usually immediately to achieve the fastest cooling of the surface of the workpiece. (In other cases it may not be necessary to commence cooling immediately, in which case there would be a delay in the cooling process following the heating process.) Thus, the SGJC cooling is commenced in vacuum, and the vacuum is gradually degraded as coolant enters the system through the cooling process. If desired, the resulting coolant gas could be removed using the vacuum pump 24, but normally the cooling is not adversely affected by its presence.

The apparatus 20", utilizes plasma electron heating and SGJC cooling together. These techniques can be used separately as well. Plasma electron heating can be used with other cooling techniques such as high-pressure gas cooling, or without any forced cooling of the workpiece. SGJC cooling can be used with other heating techniques.

FIG. 8 depicts the heating aspect of heat treating a workpiece according to the approach of the invention as described previously. A plasma of an ionizing gas is formed around the workpiece, numeral 90. Electrons are accelerated from the plasma to the workpiece with pulses of positive voltage applied to the workpiece, numeral 92, thereby heating the workpiece. The heating is continued until a preselected temperature state of the surface of the entire thickness of the workpiece is achieved, numeral 94. The workpiece may thereafter be cooled, by SGJC cooling or any other technique.

FIG. 9 depicts the cooling aspect of heat treating a workpiece according to the approach of the invention as described previously. The workpiece is heated, numeral 100, either by plasma electron heating as described previously, or otherwise. The workpiece is thereafter cooled by directing a flow of solid cooling particles at the workpiece. The flow is produced by supplying a pressurized liquid material having a thermodynamic triple point of equilibrium between its liquid, solid, and gaseous forms, numeral 102. A flow of the liquid material is expanded from a higher pressure to a lower pressure to produce the solid particulate form of the material, numeral 104. The particles are directed toward the workpiece, numeral 106.

The plasma electron heating and SGJC cooling of the invention have been implemented in an apparatus of sufficient size to demonstrate commercial operability. The apparatus had a vacuum chamber that was four feet in diameter and eight feet in length, and a power source 48 with a power output of 100,000 watts. This permitted the heat treating of commercial-sized workpieces.

The following examples are presented to illustrate aspects of the invention and its practice, but should not be taken as limiting of the invention in any respect.

EXAMPLE 1

Automotive pinion gear blanks made of type 5130 steel were "normalize" heat treated using plasma electron heating with the apparatus according to the invention. Normalizing heat treatment does not require any accelerated cooling of the workpiece, and therefore provides an indication of the plasma electron heating approach. Each gear blank had a diameter of 2 inches and weighed about one pound. Nine of the gear blanks were supported in the apparatus. The gear blanks were identically treated. The apparatus operating parameters were an applied voltage of the power source 48 of 30 kilovolts, an average pulsed current of 150 amperes, an average current from the power supply to the workpieces of about 0.25 amperes, a pulse repetition frequency of 200 Hertz, a pulse width of 10 microseconds, and argon ionizing gas at a working pressure of $3\times10^{-5}$ Torr. The gear blanks were heated to a surface and bulk temperature of 900° C. in about 5 minutes and maintained at that temperature for 15 minutes. After the 15 minute heating period was complete, the power was discontinued, and the gear blanks were allowed to cool by radiation in the vacuum. No forced cooling, such as SGJC or high-pressure gas cooling, was used in the normalizing treatment.

The microstructures of the normalized gear blanks were studied. One question of concern was whether all nine gear blanks processed at once would have similar structures, and whether those structures would be similar to those of gear blanks that were conventionally normalized in a gas furnace. The studies showed that the microstructures of all nine gear blanks were similar, and that their microstructures were comparable to those of conventionally normalized gear blanks. This result demonstrated that the plasma enveloped the nine gear blanks uniformly. It also showed that the plasma electron heating process could duplicate the microstructures of conventionally normalized gear blanks, but in a time reduced due to the faster plasma electron heating time of 5 minutes as compared with the conventional heating time of 30 minutes.

EXAMPLE 2

Samples of the gear blanks normalized as discussed in Example 1 were carburized and quench hardened in a commercial facility. Gears that were normalized in a conventional furnace were similarly treated, and the property results compared. The surface hardness of the plasma electron normalized and carburized/quench hardened gears was 82–83 $R_a$, and the surface hardness for the conventionally processed gears was 81–82 $R_a$. The core hardness of each type of gear remained at about 47–48 $R_a$. The case depth of the plasma electron processed gears was 0.48 millimeters, and the case depth of the conventionally processed gears was 0.45 millimeters.

These results demonstrate that the plasma electron heating process is as controllable as conventional heat treating. However, it has the advantages over conventional heat treating discussed elsewhere herein.

EXAMPLE 3

Gear samples of type 5130 gear material were treated by rapid burst pulse plasma electron heating to achieve preferential surface heating without significant interior heating. The samples were heated using 100 kilovolt pulses, 10 microseconds pulse duration, a burst time of 0.5 seconds, and a total of 500 pulses per burst. The power density on the surface of the samples was about 1.5 kilowatts per square centimeter.

The temperature of the surface of the gear material was measured with an infrared optical pyrometer having a response time of 0.1 seconds. During one burst of pulses, the surface of the gear reached 1000° C. and then reduced to 500° C. in less than 3 seconds by self quenching of the surface by the underlying mass of interior metal.

Examples 1 and 2 demonstrate the use of slow, continuous heating of a workpiece using plasma electron heating with no forced cooling. This Example 3 demonstrates the rapid burst heating mode with no forced cooling.

EXAMPLE 4

To demonstrate SGJC cooling, an apparatus like that of FIG. 3 was constructed. The coolant material wag carbon dioxide, maintained in the source at 835 pounds per square inch. The nozzle of the cooling apparatus was sized such that the throughput of carbon dioxide under these conditions was about 100 pounds per minute.

A steel workpiece was heated to 1000° C. It was then cooled using the SGJC apparatus, and the temperature of the workpiece measured during cooling. FIG. 10 shows the temperature at a distance of about 2.5 millimeters below the surface of the workpiece as a function of time, as measured by an embedded thermocouple. The effective heat transfer coefficient was estimated from these measurements to be about 5500 watts per square meter-degree K.

For comparison, the same steel workpiece was again heated to 1000° C. and cooled by immersion into oil quenchant. FIG. 10 shows that the temperature reduction as a function of time for the oil quench is slower than for the SGJC quench.

From the technical literature, it is known that the heat transfer coefficient for high-pressure gas cooling using helium at a pressure of 20 atmospheres is about 1000 watts per square meter-degree K, and for hydrogen at a pressure of 20 atmospheres about 2200 watts per square meter-degree K. The heat transfer coefficient for unagitated oil is about 1500 watts per square meter-degree K, and for agitated oil about 2200 watts per square meter-degree K. The heat transfer coefficient for agitated water is about 3500 watts per square meter-degree K.

Thus, the heat transfer coefficient for SGJC cooling is superior to that of the previously most preferred approach for vacuum heated workpieces, high-pressure gas cooling, by a factor of 2–5. It is even superior to traditional liquid quenchants such as oil and water by a factor of 1.5–2. The SGJC process has the important advantage that it leaves no residue on the surface of the cooled workpiece and is environmentally preferred as compared with quenching in oil, polymers, salt solutions, and the like.

EXAMPLE 5

Gear material was surface hardened by heating, using plasma electron heating, and subsequent accelerated cooling, using carbon dioxide SGJC. Test samples were made from type 5130 steel, the same steel used to make the gears processed in Example 1. The samples were plasma electron heated to a temperature of about 900° C. The plasma electron heating parameters were an applied voltage of 55 kilovolts, peak pulsed current of 30 amperes, burst pulses with 700–800 pulses per burst, pulse repetition frequency of 1000 Hertz, pulse width of 10 microseconds, nitrogen ionizing gas, and working pressure of less than $3\times10^{-5}$ Torr. With these parameters, the samples required 5 minutes to reach temperature, and were maintained at temperature for 5 minutes thereafter. After the heating was complete, the power was discontinued.

A surface of each of the samples was thereafter cooled using the SGJC apparatus.

After cooling, the samples were sectioned for microstructural examination. The microstructure showed a martensitic phase in the surface regions, the desired result.

EXAMPLE 6

The processing of Example 5 was repeated, except using actual gears. To achieve cooling on all sides of the gears, a toroidal dispersing jet device like that discussed in relation to FIG. 5 was used. The gears were successfully heated using the same plasma electron heating parameters discussed for Example 5, and cooled using the SGJC apparatus with the dispersing jet device.

EXAMPLE 7

Example 6 was repeated using a sequence of six identical gears, and one gear was retained in the untreated state as a control. The six gears were heated to different maximum temperatures by plasma electron heating, and cooled by SGJC using the toroidal dispersing jet device.

After cooling, the microstructures were examined and the hardnesses of the surface regions were measured. The hardnesses were as follows:

TABLE

| Sample No. | Max. Temp (deg F.) | Hardness ($R_a$) |
|---|---|---|
| 1 | 1700 | 69 |
| 2 | 1800 | 71 |
| 3 | 1900 | 72 |
| 4 | 2000 | 75 |
| 5 | 2000 | 75 |
| 6 | 2000 | 74 |
| Control | — | 50–51 |

The microstructure of Sample No. 2, heated to 1800° F., was judged to have the fine-grained, martensitic structure and hardness that are preferred for the surface hardened gears of this type. Samples 4, 5, and 6 demonstrate good repeatability of the treatment process, as indicated by the same (or nearly the same) hardness that is reached in each of the three runs.

The present approach thus provides a method and apparatus for plasma electron heating and solid/gas jet cooling of workpieces, having the advantages over prior approaches as discussed herein. Although particular embodiments of the invention have been described in detail for purposes of illustration, various modifications may be made without departing from the spirit and scope of the invention. Accordingly, the invention is not to be limited except as by the appended claims.

What is claimed is:

1. A method of heat treating at least one workpiece, comprising the steps of:

providing at least one workpiece;

selecting a heat treatment procedure for the at least one workpiece;

forming a plasma of an ionizing gas around the at least one workpiece, the plasma containing free electrons therein;

accelerating electrons from the plasma to the at least one workpiece with a series of pulses of positive voltage, relative to the plasma, applied to the workpiece to heat the workpiece; and continuing the step of accelerating until the heat treatment procedure has been performed in the at least one workpiece, and including the following additional steps, after the step of continuing:

discontinuing the step of accelerating, and performing accelerated cooling of the workpiece, wherein the step of performing includes the step of:

directing at the workpiece a stream comprising a mixture of a gaseous and a solid form of a coolant material.

2. The method of claim 1, including the additional step of directing at the workpiece a second stream comprising a mixture of the gaseous and the solid forms of a second coolant material.

3. The method of claim 1, wherein the step of directing includes the step of providing a stream comprising a mixture of solid and gaseous carbon dioxide.

4. A method of heat treating a workpiece, comprising the steps of:

heating the workpiece;

directing a flow of solid particles at the workpiece, the flow being produced by the steps of supplying a pressurized liquid material having a thermodynamic triple point of equilibrium between its liquid, solid, and gaseous forms, expanding a flow of the liquid material from a higher pressure to a lower pressure to produce a solid form of the material, and directing the expanded solid flow toward the workpiece.

5. The method of claim 4, wherein the step of heating is performed by creating a plasma around the workpiece, and accelerating electrons from the plasma into the workpiece.

6. The method of claim 4, wherein the step of supplying a pressurized liquid material includes the step of supplying pressurized carbon dioxide.

7. A method of heat treating at least one workpiece, comprising the steps of:

providing at least one workpiece that is to be heat treated;

selecting a heat treatment procedure for the at least one workpiece;

providing an apparatus for heat treating a workpiece, the apparatus comprising:

a vacuum chamber;

means for controllably evacuating the vacuum chamber, means for controllably supplying a partial pressure of an ionizing gas to the interior of the vacuum chamber, means for providing a plasma within the vacuum chamber, and an electrically isolated support for the at least one workpiece to be heat treated;

placing the at least one workpiece into the vacuum chamber on the electrically isolated support;

generating a plasma having free electrons therein within the vacuum chamber using the means for providing a plasma; and applying a pulsing positive voltage to each workpiece relative to the plasma to perform the heat treatment procedure, wherein the step of providing an apparatus includes the steps of:

providing an expansion nozzle directed toward a location of the at least one workpiece when it is held on the support, providing a pressurized source of a liquid material having a thermodynamic triple point of equilibrium between its liquid, solid, and gaseous forms, and providing a conduit controllably extending from the source of the liquid material to the nozzle.

8. The method of claim 7, including an additional step, after the step of applying, of directing a flow of the liquid material through the expansion nozzle and toward the at least one workpiece.

* * * * *